US005562092A

United States Patent [19]

George

[11] Patent Number: 5,562,092

[45] Date of Patent: Oct. 8, 1996

[54] FIREFIGHTER'S EMERGENCY SMOKE FILTER

[76] Inventor: Eric W. George, 100 Forest Hill Rd., North Haven, Conn. 06473

[21] Appl. No.: 506,996

[22] Filed: Jul. 31, 1995

Related U.S. Application Data

[63] Continuation of Ser. No. 75,838, Jun. 14, 1993, abandoned.

[51] Int. Cl.[6] ..... A62B 7/10

[52] U.S. Cl. ..... 128/201.25; 128/202.27; 128/205.27; 128/206.15; 128/207.12

[58] Field of Search ..... 128/205.27, 205.28, 128/205.29, 206.12, 206.17, 201.25, 202.27, 206.15, 207.12

[56] References Cited

U.S. PATENT DOCUMENTS

| | | | |
|---|---|---|---|
| 1,730,227 | 10/1929 | McBride | 128/206.17 |
| 2,583,304 | 1/1952 | Pipher | 128/201.25 |
| 3,072,119 | 1/1963 | Matheson | 128/206.17 |
| 3,202,150 | 8/1965 | Miller | 128/202.27 |
| 3,944,403 | 3/1976 | Simpson et al. | 55/316 |
| 4,440,163 | 4/1984 | Spergel | 128/205.13 |
| 4,453,544 | 6/1984 | Silverthorn | 128/206.17 |
| 4,549,543 | 10/1985 | Moon | 128/206.12 |
| 4,559,939 | 12/1985 | Levine et al. | 128/201.28 |
| 4,573,463 | 3/1986 | Hall | 128/205.24 |
| 4,793,342 | 12/1988 | Haber et al. | 128/202.27 |
| 4,841,953 | 6/1989 | Dodrill | 128/202.27 |
| 4,932,399 | 6/1990 | Cappa et al. | 128/202.27 |
| 5,033,507 | 7/1991 | Pouchot | 137/550 |
| 5,038,768 | 8/1991 | McGoff et al. | 128/202.26 |
| 5,297,544 | 3/1994 | May et al. | 128/202.22 |
| 5,318,019 | 6/1994 | Celaya | 128/204.26 |

FOREIGN PATENT DOCUMENTS

| | | | |
|---|---|---|---|
| 797538 | of 0000 | France | 55/DIG. 33 |
| 426298 | 4/1935 | United Kingdom | 55/DIG. 33 |

*Primary Examiner*—Aaron J. Lewis
*Attorney, Agent, or Firm*—DeLio & Peterson

[57] ABSTRACT

An emergency smoke filter for use by firefighters and the like has two stages: the first stage is a paper filter and the second stage is a charcoal filter. The emergency smoke filter is intended for use only in the event that a firefighters primary source of breathing clean air (a self-contained breathing apparatus or SCBA) malfunctions or runs out of air in a toxic, smoke filled environment. The emergency smoke filter does not replace an SCBA but augments it in case the SCBA is not working. The emergency smoke filter attaches to the firefighters SCBA in the slot for the regulator once the regulator is removed. The emergency smoke filter is intended for only one use and it can be deposed of thereafter.

20 Claims, 4 Drawing Sheets

FIREFIGHTER'S EMERGENCY SMOKE FILTER

BACKGROUND OF THE INVENTION

This application is a continuation of U.S. application Ser. No. 08/075,838 filed Jun. 14, 1993 now abandoned.

FIELD OF THE INVENTION

The present invention relates generally to firefighters' equipment, and more particularly, to a smoke filter especially adapted to provide firefighters with cleaner breathing air in an emergency situation.

DESCRIPTION OF THE PRIOR ART

Self contained breathing apparatuses (SCBA) in the form of a face mask having a means for attaching a regulator from an air or oxygen source are well known in the art of firefighters' equipment.

Thus, while the foregoing body of prior art indicates it to be well known to use SCBA devices to provide air or oxygen to firefighters while they are in a smoke/toxics filled environment, the provision of a simple and cost effective device which can be attached to an SCBA to filter the smoke/toxics filled air in case the air/oxygen source is empty or in case their is an SCBA malfunction is not contemplated. Nor does the prior art described above teach or suggest a single use emergency smoke filter device which can be carried in a sealed case until needed and which may be used by firefighters and other individuals to augment an empty or malfunctioning SCBA. The foregoing disadvantages are overcome by the unique emergency air filter of the present invention as will be made apparent from the following description thereof. Other advantages of the present invention over the prior art also will be rendered evident.

SUMMARY OF THE INVENTION

To achieve the foregoing and other advantages, the present invention, briefly described, provides an emergency smoke filter for use by firefighters and the like having two stages: the first stage being a paper filter and the second stage being a charcoal filter. The emergency smoke filter is intended for use only in the event that firefighters primary source of breathing clean air (a self-contained breathing apparatus or SCBA) malfunctions or runs out of air in a toxic, smoke filled environment. The emergency smoke filter does not replace an SCBA but augments it in case the SCBA is not working. The emergency smoke filter attaches to the firefighters SCBA in the slot for the regulator once the regulator is removed. The emergency smoke filter is intended for only one use and it can be disposed of thereafter.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings.

The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved firefighter's emergency smoke filter which has all of the advantages of the prior art and none of the disadvantages.

It is another object of the present invention to provide a new firefighter's emergency smoke filter which may be easily and efficiently manufactured and marketed.

It is a further objective of the present invention to provide a new firefighter's emergency smoke filter which is of durable and reliable construction.

An even further object of the present invention is to provide a new firefighter's emergency smoke filter which is susceptible of a low cost of manufacture with regard to both materials and labor, and which accordingly is then susceptible of low prices of sale to the consuming public, thereby making such smoke filter available to the buying public.

Still yet a further object of the present invention is to provide a new firefighter's emergency smoke filter for use by firefighters and the like having two stages: the first stage being a paper filter and the second stage being a charcoal filter.

It is still a further object of the present invention to provide a new firefighter's emergency smoke filter intended for use only in the event that a firefighters primary source of breathing clean air (a self-contained breathing apparatus or SCBA) malfunctions or runs out of air in a toxic, smoke filled environment.

Still a further object of the present invention is to provide a new firefighter's emergency smoke filter which does not replace an SCBA but only augments it in case the SCBA is not working or the air source is empty.

Even still yet a further object of the present invention is to provide a new firefighter's emergency smoke filter which attaches to a firefighters SCBA in the slot for the regulator once the regulator is removed.

It is even still a further object of the present invention to provide a new firefighter's emergency smoke filter which is intended for only one use and which can be disposed of thereafter.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT(S)

With reference now to the drawings, a new smoke filter embodying the principles and concepts of the present invention will be described.

Figure 1:
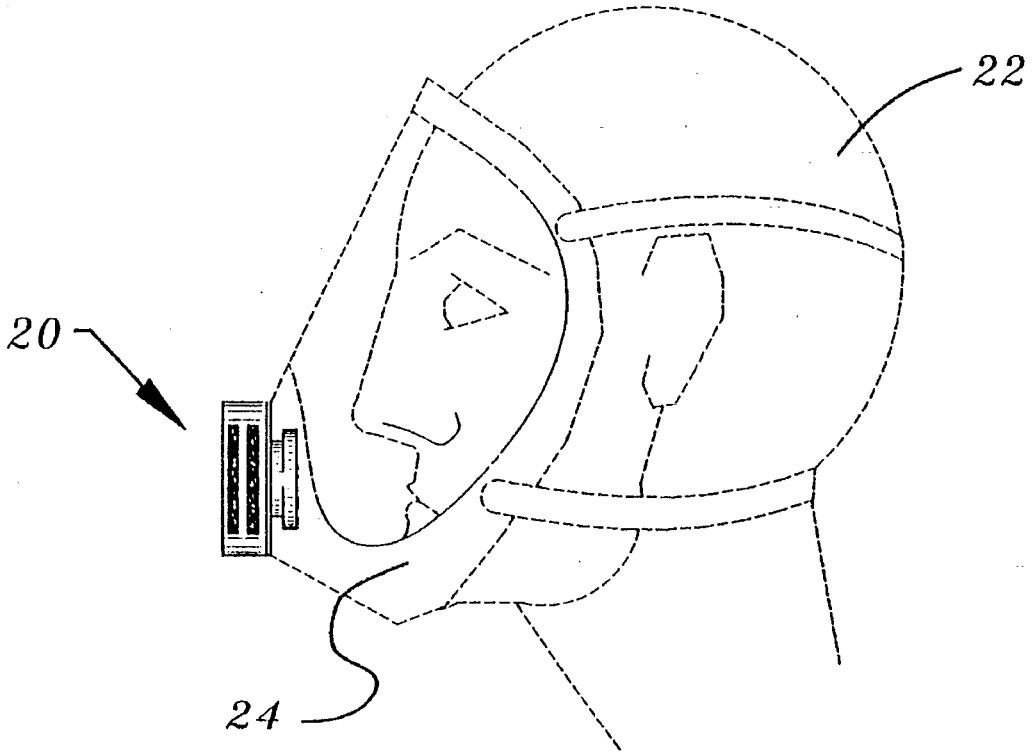
FIG. 1 is a perspective view showing the preferred embodiment of the firefighter's emergency smoke filter of the present invention on a firefighter.
Figure 2:
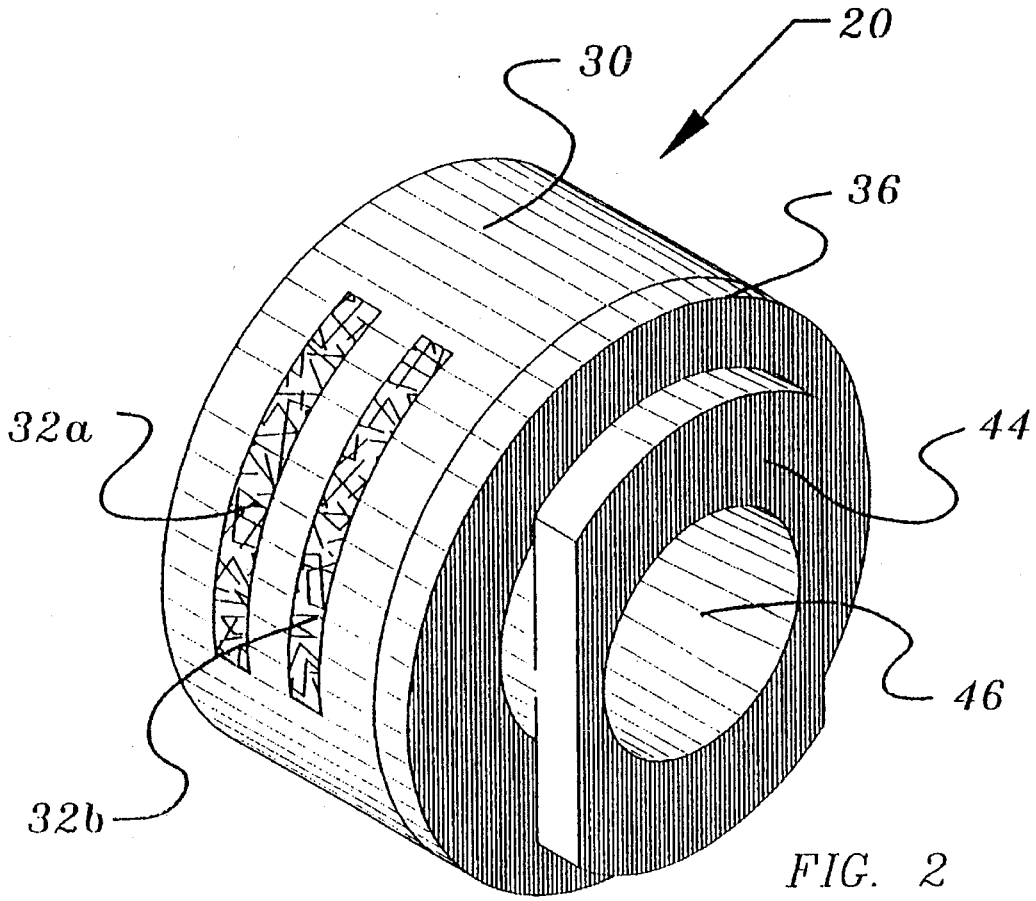
FIG. 2 is a perspective elevational view of the smoke filter of FIG. 1 in accordance with the present invention.
Figure 3:
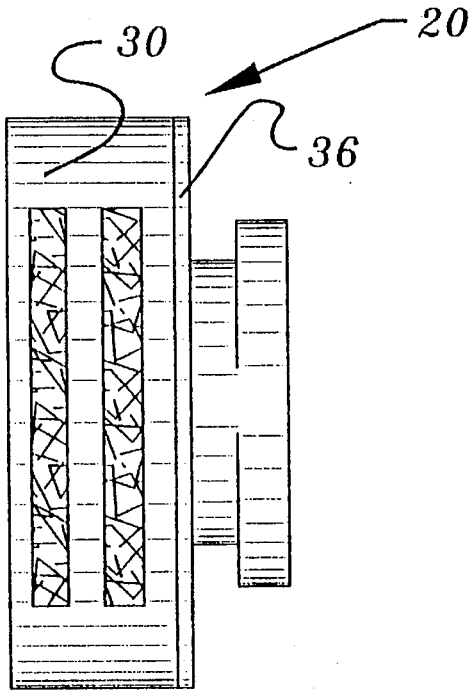
FIG. 3 is a perspective side view of the smoke filter of FIGS. 1 and 2 in accordance with the present invention.
Figure 4:
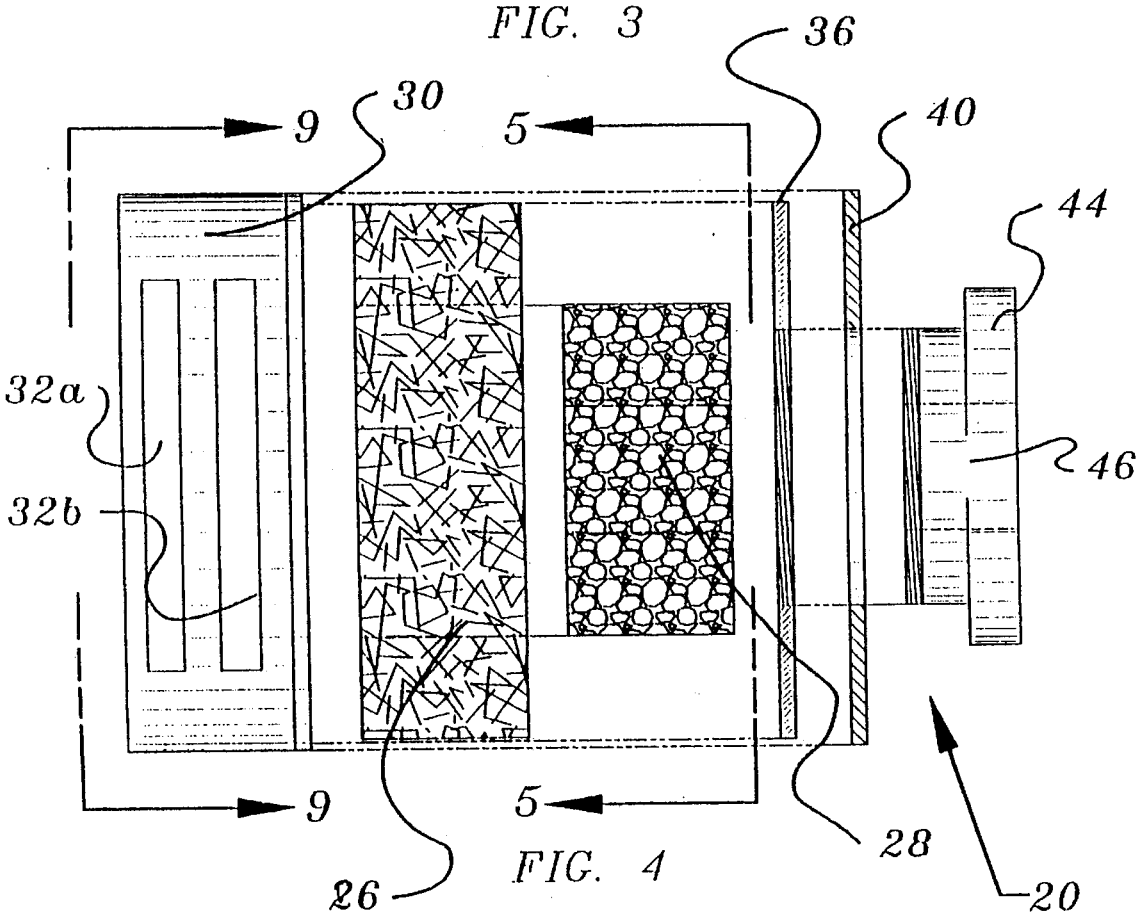
FIG. 4 is a cross-sectional broken apart view of the smoke filter of FIGS. 1–3 in accordance with the present invention.
Figure 5:
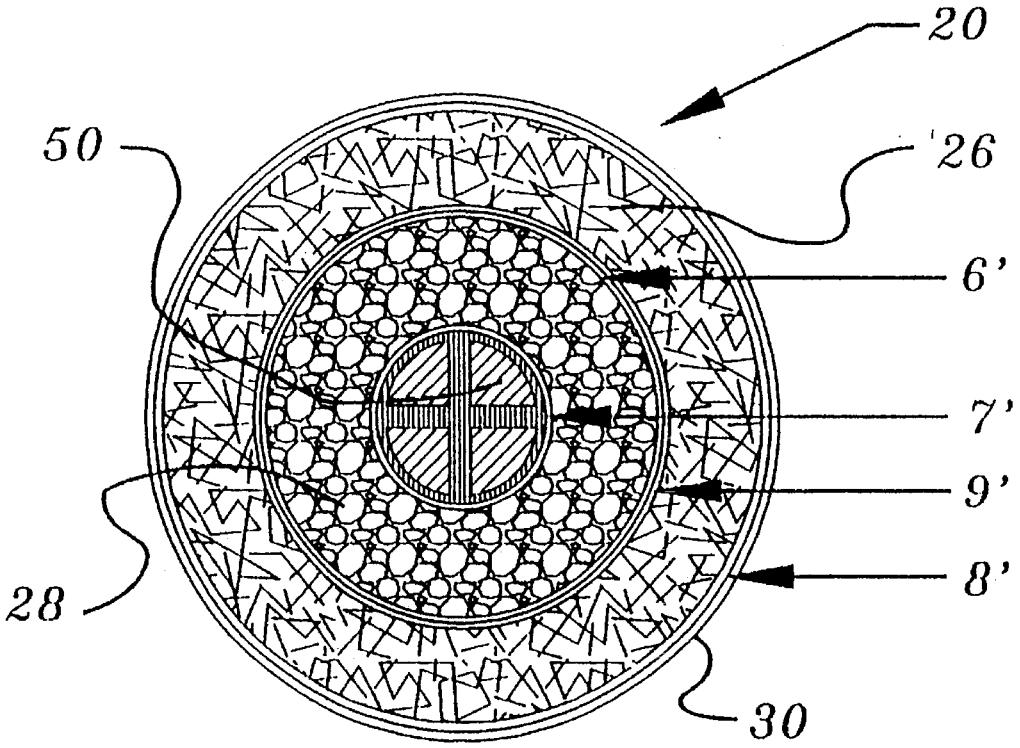
FIG. 5 is a cross-sectional side view of the smoke filter of the present invention taken along line 55 FIG. 4.
Figure 6:
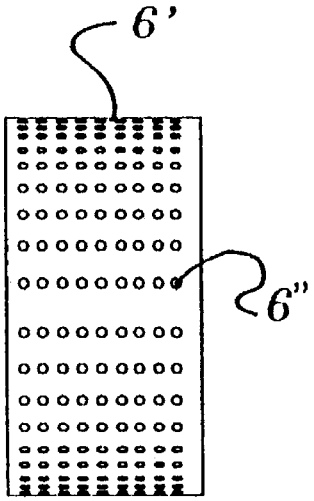
FIGS. 6–8 are perspective views of filter media holders for use with the present invention.
Figure 7:
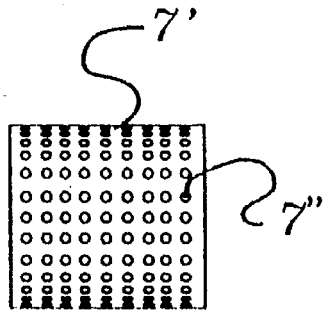
Figure 8:
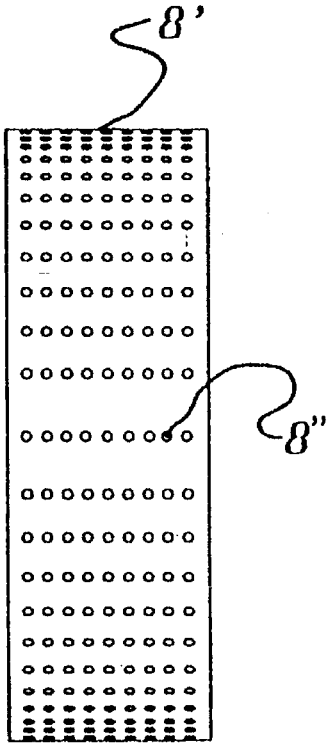

An exemplary embodiment of a firefighter's emergency smoke filter of the invention is shown in the figures and is generally designated by reference numeral 20. Turning initially to FIG. 1, the exemplary embodiment of the smoke filter 20 of the invention is shown in use attached to a self contained breathing apparatus (SCBA) mask 24 on the head 22 of a firefighter. Now referring to FIGS. 2–5 (particularly FIG. 5) emergency smoke filter 20, in its preferred form, comprises generally a filter case 30 having a pair of air openings 32*a* and 32*b*. A two stage filter system is contained within the case 30. The first filter stage is a paper filter 26. The second stage is a charcoal filter 28. The paper filter 26 surrounds the charcoal 28 so that air entering holes 32*a* and 32*b* must first pass through paper filter 26 and then charcoal filter 28.

Figure 9:
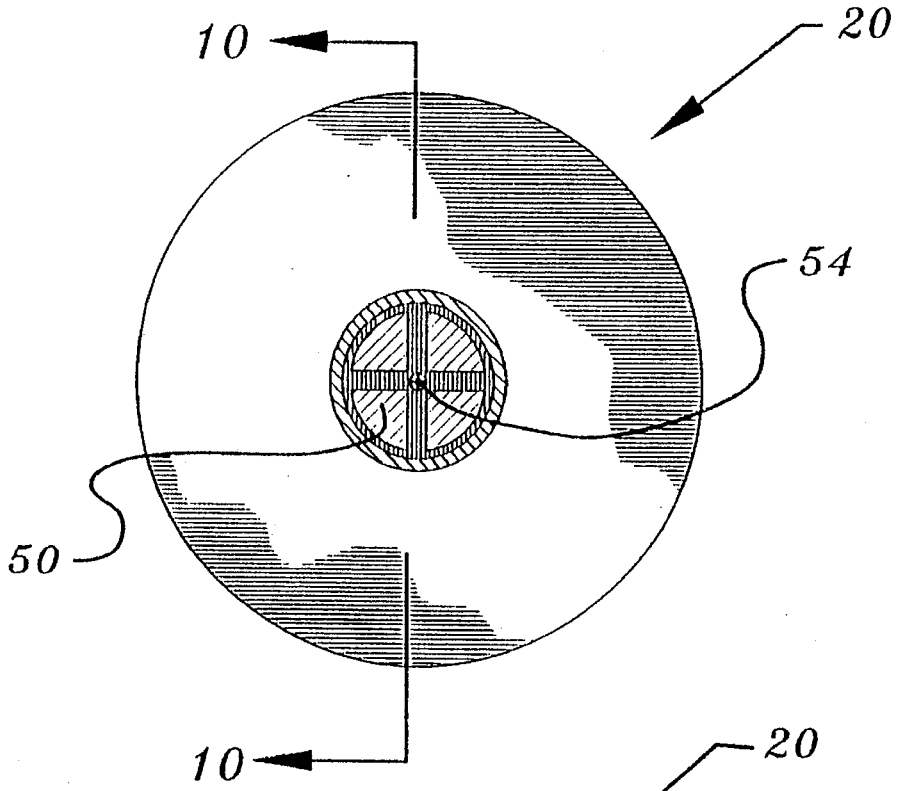
FIG. 9 is a perspective side view showing the firefighter's emergency smoke filter of the present invention along line 99 in FIG. 4.
Figure 10:
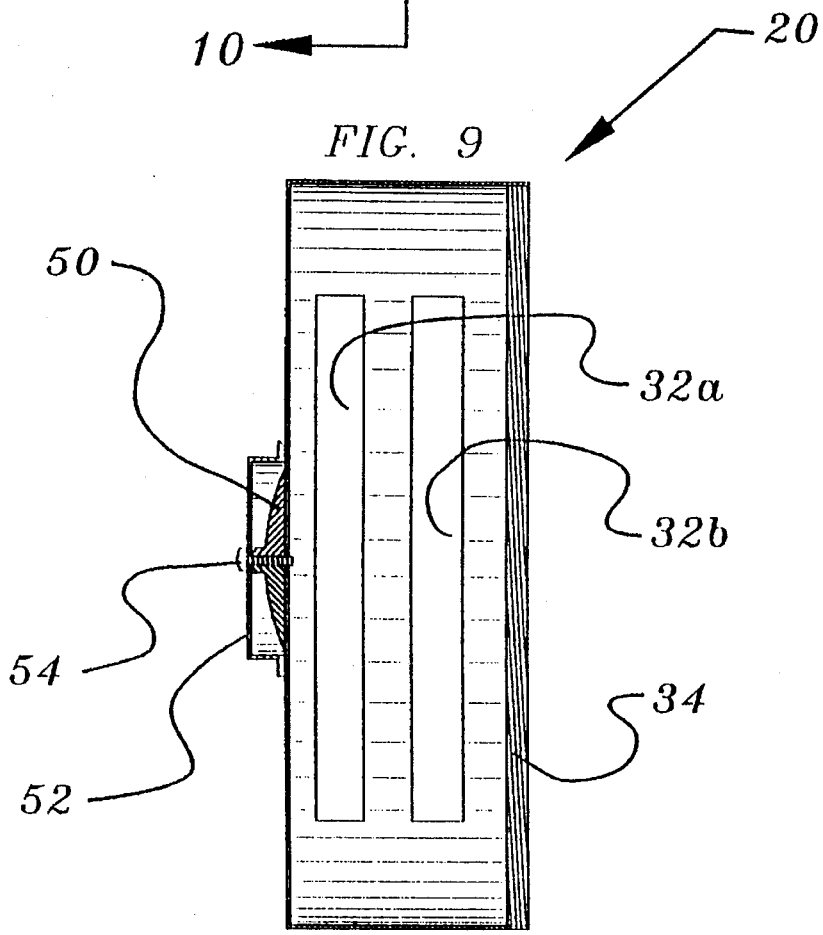
FIG. 10 is a perspective side view of the smoke filter of the present invention along line 10—10 of FIG. 9.

The filter case is threaded with threads 34 (see FIG. 9) adapted to fit a threaded filter case cover 36. A rubber gasket 40 prevents any leaks between the case 30 and the cover 36.

A mask adapter 44 is used to attach the emergency filter system 20 to a SCBA. The adapter 44 should be constructed to fit on a specific type brand or model of SCBA. Different brands and/or models may require different adapters. For example, the adapter can be constructed to attach to Scott Air Pack SCBA, a popular model. Filtered air passes through air passage 46 to the firefighter. Preferably, the adapter 44 comprises an unlabeled cylindrical projection having first and second ends and being coupled to the case cover 36 at the first end of the cylindrical projection, with the air passage 46 extending through the cylindrical projection. An unlabeled flange is coupled to the second end of the cylindrical projection and extends orthogonally relative to said air passage. Preferably, the flange includes a pair of opposed straight sides and a pair of opposed arcuate sides.

Exhaust air from the firefighter also passes through air passage 46 and exits the air filter system 20 through exhaust diaphragm 50 without going through the filters 26 or 28. The exhaust diaphragm is preferably made of a rubber material. A cover 52 holds the exhaust diaphragm 50 in place.

FIGS. 5–8 show how the filters 26 and 28 are held in place. The charcoal of charcoal filter 28 is contained between an inner charcoal holder 6' (having holes 6") and an outer charcoal holder 7' (having holes 7"). The paper of paper filter 26 is contained between outer paper holder 8' (having holes 8") and an inner paper holder 9' (not shown in detail). Alternatively, outer charcoal holder 7" could also act as the inner holder of the paper, eliminating the need for inner paper holder 9".

The small holes (6", 7" etc.) in the holders are large enough to allow air to pass through while small enough to prevent the paper or charcoal media from passing through.

Use of the firefighter's emergency air filter of the present invention is very easy. If a firefighter is in a smoke or other toxic environment he will probably be using an SCBA unit. If for some reason the SCBA unit malfunctions or the air or oxygen supply becomes empty the firefighter will not be able to breathe. If the firefighter is carrying an emergency smoke filter in accordance with the present invention he can quickly remove it from its sealed carrying case, detach the regulator unit from his mask, and attach the emergency smoke filter to the slot in the mask where the regulator was previously. Using the emergency smoke filter, the firefighter will have a good chance of making his way to safety, or if trapped, surviving until being rescued. After being used, the emergency smoke filter can be disposed of since it is intended for only one emergency use.

It is apparent from the above that the present invention accomplishes all of the objectives set forth by providing a new smoke filter for emergency use by firefighters and the like who use self contained breathing apparatuses with masks comprising: at least one filter means with filter media; a case means for containing the at least one filter means; an exhaust means for allowing exhaust air to pass through the casing without passing through the filter means and without allowing outside environment air to enter the casing through the exhaust means; an attaching means for attaching the casing to the mask of the self contained breathing apparatus; whereby, if the firefighters self contained breathing apparatus fails or runs out of air, the attaching means can be attached and outside environment air can be breathed in and will be filtered by said at least one filter means. The at least one filter means can be two filter means comprised of a first filter means and a second filter means serially air flow connected to the first filter means. The first filter means can be a paper media filter and the second filter means can be a charcoal medial filter. The casing can be cylindrical in shape and can have openings on its side to allow air to enter.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationship equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary sill in the art that many modifications thereof may be made without departing from the principles and concepts set forth herein. Hence, the proper scope of the present invention should be determined only by the broadest interpretation of the appended claims so as encompass all such modifications and equivalents.

I claim:

1. A method for prolonging breathing through a self contained breathing apparatus for use in emergencies comprising the steps of:

a) providing a self contained breathing apparatus including a mask securable over the face of an individual and a regulator removably couplable to said mask containing an air supply, and an emergency smoke filter removably couplable to said mask in place of said regulator;

b) coupling said regulator and air supply to said mask through an opening in said mask;

c) utilizing said air supply as a primary source of breathable air until said air supply malfunctions or is depleted;

d) removing said regulator and air supply from the opening in said mask;

e) replacing said regulator and air supply with said smoke filter by coupling said filter to said opening in said mask; and f) utilizing said filter system to filter smoke or toxins from air in the environment.

2. The method of claim 1 wherein said smoke filter comprises a filter case having at least one aperture extending therethrough, a first filter means for filtering air, said first filter means being positioned within said filter case; and mounting means for mounting said filter case to said mask of said self contained breathing apparatus, and wherein during step (f) an individual breathes in outside environment air filtered through said first filter means.

3. The method of claim 2 wherein said mounting means comprises a case cover removably coupled to said open end of said filter case, and an adapter having an air passage extending therethrough, said adapter being coupled to said case cover such that said air passage is in fluid communication with said first filter means, said adapter being selectively engageable to said mask in place of said regulator, and wherein during step (f) an individual breathes filtered air passing through said air passage.

4. The method of claim 3 and further comprising a second filter means for filtering air, said second filter means comprising a second substantially cylindrical filter concentrically disposed within said first filter, and wherein during step (f), an individual breathes in filtered air through said second filter means.

5. An emergency smoke filter kit comprising:

a self contained breathing apparatus including a mask securable over a face of an individual, and a regulator removably coupled to said mask; and a smoke filter removably couplable to said mask of said self contained breathing apparatus in place of said regulator.

6. The emergency smoke filter kit of claim 5, wherein said smoke filter comprises a filter case having at least one aperture extending therethrough, a first filter means for filtering air, said first filter means being positioned within said filter case; and mounting means for mounting said filter case to said mask of said self contained breathing apparatus.

7. The emergency smoke filter kit of claim 6, wherein said filter case is substantially cylindrical in shape and includes an outer sidewall with an open end and a closed end, with said at least one aperture extending through said sidewall of said filter case, and further wherein said first filter means comprises a first substantially cylindrical filter disposed within said filter case.

8. The emergency smoke filter kit of claim 7, wherein said mounting means comprises a case cover removably coupled to said open end of said filter case, and an adapter having an air passage extending therethrough, said adapter being coupled to said case cover such that said air passage is in fluid communication with said first filter means, said adapter being selectively engageable to said mask in place of said regulator.

9. The emergency smoke filter kit of claim 8, and further comprising a second filter means for filtering air, said second filter means comprising a second substantially cylindrical filter concentrically disposed within said first filter.

10. The emergency smoke filter kit of claim 9, wherein said adapter comprises a cylindrical projection having first and second ends and being coupled to said case cover at said first end of said cylindrical projection, with said air passage extending through said cylindrical projection, and a flange coupled to said second end of said cylindrical projection and extending orthogonally relative to said air passage, said flange being substantially planar and having a pair of opposed straight sides and a pair of opposed arcuate sides.

11. The emergency smoke filter kit of claim 10, and further comprising a gasket interposed between said case cover and said adapter.

12. The emergency smoke filter kit of claim 11, wherein said first filter comprises a paper filter and said second filter comprises a charcoal filter.

13. The emergency smoke filter kit of claim 12, and further comprising an inner paper holder and an outer paper holder, said paper holders being substantially cylindrical in shape and being concentrically disposed about said first filter; and an inner charcoal holder and an outer charcoal holder, said charcoal holders being substantially cylindrical in shape and being concentrically disposed about said second filter.

14. The emergency smoke filter kit of claim 13, wherein said closed end of said filter case includes an exhaust aperture extending therethrough, and further comprising an exhaust diaphragm coupled to said filter case for permitting a one way flow of air through said exhaust aperture.

15. An emergency smoke filter kit comprising:

a self contained breathing apparatus including a mask securable over a face of an individual, and a regulator removably coupled to said mask; and a smoke filter removably couplable to said mask of said self contained breathing apparatus in place of said regulator, said smoke filter comprising a filter case having at least one aperture extending therethrough, said filter case being substantially cylindrical in shape and including an outer sidewall with an open end and a closed end, with said at least one aperture extending through said sidewall of said filter case;

a first filter means for filtering air, said first filter means comprises a first substantially cylindrical filter disposed within said filter case; and mounting means for mounting said filter case to said mask of said self contained breathing apparatus, said mounting means comprising a case cover removably coupled to said open end of said filter case, and an adapter having an air passage extending therethrough, said adapter being coupled to said case cover such that said air passage is in fluid communication with said first filter means, said adapter being selectively engageable to said mask in place of said regulator, said adapter comprising a cylindrical projection having first and second ends and being coupled to said case cover at said first end of said cylindrical projection, with said air passage extending through said cylindrical projection, and a flange coupled to said second end of said cylindrical projection and extending orthogonally relative to said air passage, said flange being substantially planar and having a pair of opposed straight sides and a pair of opposed arcuate sides.

16. The emergency smoke filter kit of claim 15, and further comprising a second filter means for filtering air, said second filter means comprising a second substantially cylindrical filter concentrically disposed within said first filter.

17. The emergency smoke filter kit of claim 16, and further comprising a gasket interposed between said case cover and said adapter.

18. The emergency smoke filter kit of claim 17, wherein said first filter comprises a paper filter and said second filter comprises a charcoal filter.

19. The emergency smoke filter kit of claim 18, and further comprising an inner paper holder and an outer paper holder, said paper holders being substantially cylindrical in shape and being concentrically disposed about said first filter; and an inner charcoal holder and an outer charcoal holder, said charcoal holders being substantially cylindrical in shape and being concentrically disposed about said second filter.

20. The emergency smoke filter kit of claim 19, wherein said closed end of said filter case includes an exhaust aperture extending therethrough, and further comprising an exhaust diaphragm coupled to said filter case for permitting a one way flow of air through said exhaust aperture.

* * * * *